US006046581A

United States Patent [19]

Burgyan

[11] Patent Number: 6,046,581

[45] Date of Patent: Apr. 4, 2000

[54] MICROPROCESSOR LOAD EMULATOR

[75] Inventor: Lajos Burgyan, Palo Alto, Calif.

[73] Assignee: Semtech Corporation, Santa Clara, Calif.

[21] Appl. No.: 09/322,192

[22] Filed: May 28, 1999

[51] Int. Cl.[7] ..... G05F 1/613; G05F 1/656; G05F 1/652

[52] U.S. Cl. ..... 323/369; 323/223; 323/233

[58] Field of Search ..... 323/233, 232, 323/223, 311, 265, 267, 369

[56] References Cited

U.S. PATENT DOCUMENTS

| | | | |
|---|---|---|---|
| 3,624,489 | 11/1971 | Betton | 323/226 |
| 3,712,125 | 1/1973 | Meyer | 73/782 |
| 3,789,201 | 1/1974 | Carpenter et al. | 395/500.34 |
| 3,840,810 | 10/1974 | Fritts | 324/771 |
| 4,158,808 | 6/1979 | Massa et al. | 324/74 |
| 4,499,363 | 2/1985 | Izume et al. | 219/130.21 |
| 5,103,390 | 4/1992 | Liu | 363/132 |
| 5,559,996 | 9/1996 | Fujioka | 395/500.44 |

OTHER PUBLICATIONS

Intel, "Slot 1 Test Kit, User's Guide", Oct. 1, 1996, Revision 1.00, pp. 8–13.

*Primary Examiner*—Edward H. Tso
*Assistant Examiner*—Bao Q. Vu
*Attorney, Agent, or Firm*—D'Alessandro & Ritchie

[57] ABSTRACT

A load emulator provides a high current load having a specified high slew rate to replicate the load and transient currents generated by advanced high speed microprocessors. The load emulator is implemented in the form of an L-C delay line having taps between separate load stages wherein each of the load stages provides a load which forms a portion of the total load in the load emulator. The load emulator, can achieve and exceed a current slew rate of 1 ampere per nanosecond, and can achieve and exceed a load current of 50 amperes.

10 Claims, 6 Drawing Sheets

MICROPROCESSOR LOAD EMULATOR

BACKGROUND OF THE INVENTION

1. Field of the Invention

The present invention relates to load emulation. More particularly, the present invention relates to a load emulator suitable for testing the power supply for an advanced microprocessor having a fast slew rate and requiring high current.

2. Background

As the number of transistors employed in an integrated circuit increases, particularly, for example, in a microprocessor, the requirements for supplying power to the integrated circuit have become more demanding. It is presently contemplated that as the operating voltage (Vcc) in a microprocessor drops to approximately 1 to 1.5 volts, the current required by the microprocessor will be in a range of about 35 to about 50 amps. Accordingly, the power dissipation in the microprocessor will be at least 50 watts.

To conserve power in a multitude of applications, such as in a notebook computer, the microprocessor will switch into a "sleep" mode when not in use, as is presently understood by those of ordinary skill in the art. Additionally, certain operations of the microprocessor have power requirements which may cause large transients in the load current. Accordingly, when the microprocessor is switched from sleep mode to a waking mode, or other large transients occur, current must be provided very quickly. For a microprocessor operating at a clock rate of 1 GHz, it is anticipated that 50 amps of current must be provided to the power pins of the microprocessor at a slew rate of approximately 1 amp/nanosecond within a tolerance band that does not exceed approximately 2–3%.

The highly specialized power supplies that provide the required current to the microprocessors are characterized as low voltage, typically 1 to 3 volts, with a high load current capability of at least 75 amps. These power supplies require very fast control loops in order to be able to respond to large and fast load transients generated by state of the art microprocessors while regulating the desired output voltage within a specified tolerance. An example of such a power supply is disclosed in U.S. patent application Ser. Number 09/285,505, filed Apr. 2, 1999, entitled "AN EFFICIENT VOLTAGE REGULATOR WITH WIDE CONTROL BANDWIDTH" to Yang et al., assigned to the same assignee as the present invention, and expressly incorporated herein by reference as if set forth fully herein.

Testing of a power supply is a crucial operation that typically is performed by coupling the power supply to a load emulator, and programming the load emulator to present a changing load to the power supply. Presently, load emulators are not available that achieve the desired performance for testing the advanced power supplies required by state of the art microprocessors. For example, the Intel Corporation, Santa Clara, Calif., Load Emulator, disclosed in Intel Corporation publication "Slot 1 Test Kit User's Guide", Oct. 1, 1996, Revision 1.00, pgs. 8–13, does not suitably create a load in the manner of an advanced microprocessor and further has several other disadvantages.

The Intel Load Emulator employs an open loop topology wherein four groups of a resistor in series with a MOSFET transistor switch are connected in parallel so that various combinations of the transistor/resistor pairs are selected to provide the load of the load emulator. Due to the small number of MOSFETS employed, each MOSFET and resistor pair carries enough current to create a substantial heat dissipation problem. Despite complex and expensive selection control circuitry the Intel Load Emulator does not create a load suitable for testing advanced microprocessor power supplies.

The load is created with a variable frequency clock applied to the gate of the MOSFET transistors to simply switch between selected high and low loads. This creates a poor emulation because the load current slew rate is determined by the selected load resistance and the turn-on characteristics of the MOSFET switches. With this single step load switching, the current increment is large and the overall dI/dt curve is coarse and poorly controlled.

Further, the size of the Intel Load Emulator makes it unsuitable for testing advanced microprocessor power supplies. At high load currents and high slew rates, the parasitic inductance and parasitic resistance of conductors may substantially affect the performance of both the power supply and the load emulator. The size and the connection points of the Intel Load Emulator do not closely enough match those of an advanced microprocessor to reliably avoid the parasitic capacitance and resistance problems.

Accordingly, it is an object of the present invention to provide a load emulator that generates load current slew rates in excess of 1 A/ns to a maximum load current in excess of 50 A.

It is another object of the present invention to provide a load emulator that due to the size of the load emulator closely matches the parasitic capacitance and resistance in the load of an advanced microprocessor.

It is a further object of the present invention to provide a load emulator that avoids the use of complex control circuitry, and to eliminate the space and cost associated with such control circuitry.

It is yet another object of the present invention to provide a load emulator that provides adequate heat dissipation.

BRIEF DESCRIPTION OF THE INVENTION

In one aspect of the present invention, a load emulator provides a high current load having a specified high slew rate to replicate the load and transient currents generated by advanced high speed microprocessors. The load emulator is implemented in the form of an L-C delay line wherein each stage forms a portion of the total load in the load emulator. The load emulator with the circuit topology according to the present invention, achieves and exceeds a current slew rate of approximately 1 ampere per nanosecond, and a load current of 50 amperes.

In another aspect of the present invention, the load emulator is fabricated to occupy a space having the physical dimensions that match the size and connection points of a microprocessor. By matching these physical dimensions, the parasitic inductance and parasitic resistance in the load emulator and the interconnections to the microprocessor may be minimized.

In yet another aspect of the present invention, the L-C delay line of the load emulator may be terminated by a resistor, or additional L-C stages, or by other additional impedance matching elements. When a terminating resistor is not employed, the L-C stages or the impedance matching elements are included to minimize the impact of any reflections.

DETAILED DESCRIPTION OF A PREFERRED EMBODIMENT

Those of ordinary skill in the art will realize that the following description of the present invention is illustrative only and not in any way limiting. Other embodiments of the invention will readily suggest themselves to such skilled persons.

In the load emulator according to the present invention to be described below it should be appreciated by those of ordinary skill in the art that the load emulator may be implemented either as a lumped element network or as a transmission line network. The choice of the particular implementation will depend upon the fabrication technology of the present invention. Several examples of fabrication technologies include conventional printed circuit boards, printed circuit films, radiofrequency microwave circuit techniques, or hybrid or monolithic integrated circuit techniques. Preferably, the load emulator is constructed so that it may occupy a very small space, thereby closely matching the physical dimensions of a microprocessor in size and connection points so as to minimize the parasitic inductance and parasitic resistance of the load emulator.

Figure 1:
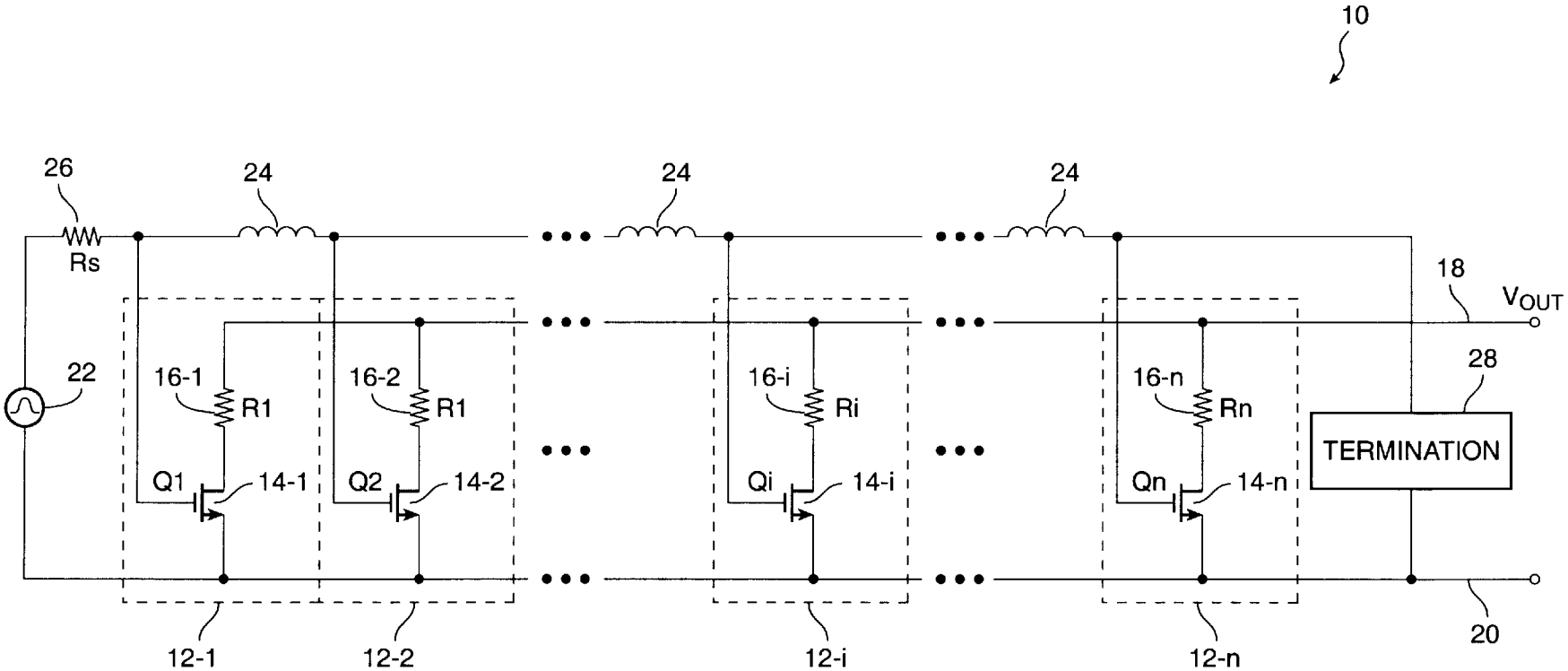
FIG. 1 is an electrical schematic diagram of a load emulator in accordance with a presently preferred embodiment of the present invention.

FIG. 1 illustrates a load emulator 10 according to the present invention. In the load emulator 10, load stages 12-1 through **12-*n* each provide a portion of a predetermined load. Each load stage 12 includes an N-channel MOS transistor 14 and a resistor 16. The N-channel MOS transistors 14 are high current, power MOSFET devices. The drain of the N-channel MOS transistor 14 is coupled to a first end of resistor 16. The load stages 12-1 through 12-*n* are connected together in parallel so that a second end of each of the resistors 16 are coupled together to form a first node 18, and the source of each of the N-channel MOS transistors 14 are coupled together to form a second node 20. The predetermined load is formed in the load emulator 10 between first and second nodes 18 and 20**.

In a presently preferred embodiment of the present invention, each of the delay elements 12 in the load emulator 10 generates a load current of approximately 1 A (ampere). The load current of 1 A is determined by the value of the resistor 16 when the N-channel MOS transistor 14 in each of the load elements 12 is turned on. All of the N-channel MOS transistors 14 in the load elements 12 are turned on by the same pulse from the pulse generator (voltage source) 22, however, all of the N-channel MOS transistors 14 are not turned on at the same time. In the load emulator 10, the inductors 24 form an inductor chain with taps connected to the gates of the N-channel MOS transistors 14. With the exception of the first load stage 12-1, it should be appreciated that there is an inductor 24 associated with each of the load stages 12-2 through **12-*n*. The inductors 24 and the gate capacitance associated with each of the N-channel MOS transistors 14** form an L-C delay line.

Accordingly, when a pulse is generated by the pulse generator 22 to turn on the N-channel MOS transistors 14, the pulse will be delayed to each of the load stages 12 by an amount of time determined by inductor 24 and N-channel MOS transistor 12 values selected to set the delay time to each load element 12. For example, when the L-C delay is set to 1 ns, and the resistor 16 value is set to conduct a load current of 1 A, the total load current will be 50 A after 50 ns. The number of load stages, and the delay time step and load current step in each of the load stages may be set as desired.

Resistor (Rs) in load emulator 10 is the source resistance of the pulse generator 22. The source resistance is preferably equal to the characteristic impedance, $Z_0$, of the load emulator 10, but it is not required to be so. It will be appreciated that $Z_0$ is determined as where L is the value of an inductor 24 and C is the value of a gate capacitance of an N-channel MOS transistor 14. The delay line is terminated with a termination element 28. Two alternative embodiments for the termination element are described below. It should be appreciated that in the load elements 12, the N-channel MOS transistors 14 act to both turn on the load element 12 and to provide a portion of the delay to the load element 12.

Figure 2:
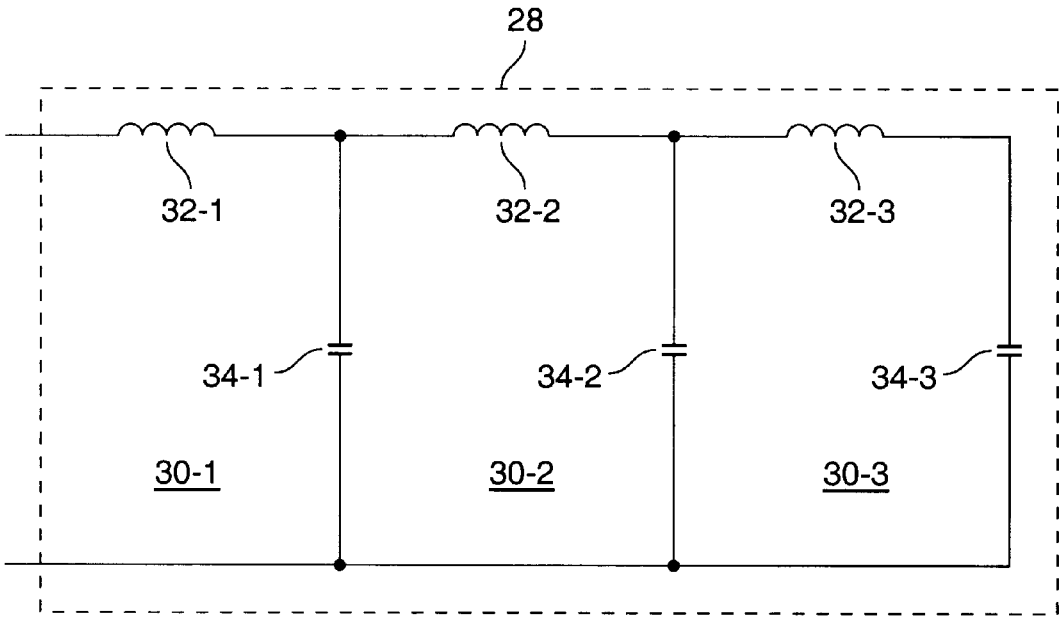
FIG. 2 is an electrical schematic diagram of the "Termination" element in the load emulator of FIG. 1 in accordance with a presently preferred embodiment of the present invention.

In a preferred embodiment, the termination element 28 comprises three additional delay stages 30-1, 30-2 and 30-3 as illustrated in FIG. 2. The three delay stages 30-1, 30-2 and 30-3 are connected in parallel, and each of the three delay stages 30-1, 30-2 and 30-3 include an inductor 32 and capacitor 34 connected in series. It should be appreciated by those of ordinary skill in the art that an N-channel MOS transistor without a load resistance coupled to its drain could be employed in place of the capacitors 34. In this embodiment, the three delay stages 30-1, 30-2 and 30-3 minimize reflection due to the absence of a termination resistor.

In an alternative embodiment, the termination element comprises a simple termination resistor. Though it will be appreciated that the use of a termination resistor is desirable in view of transmission line theory, it may also cause high load currents in the gate drive circuit. Further, it will be appreciated by those of ordinary skill in the art that depending upon the overall performance of the load emulator, that other suitable impedance matching networks may be employed as the termination element in order to achieve the most desirable load current profile.

In another alternative embodiment, the termination element comprises a suitable impedance matching network optimized as known by those of skill in the art to achieve a desired load current profile.

Figure 3A:
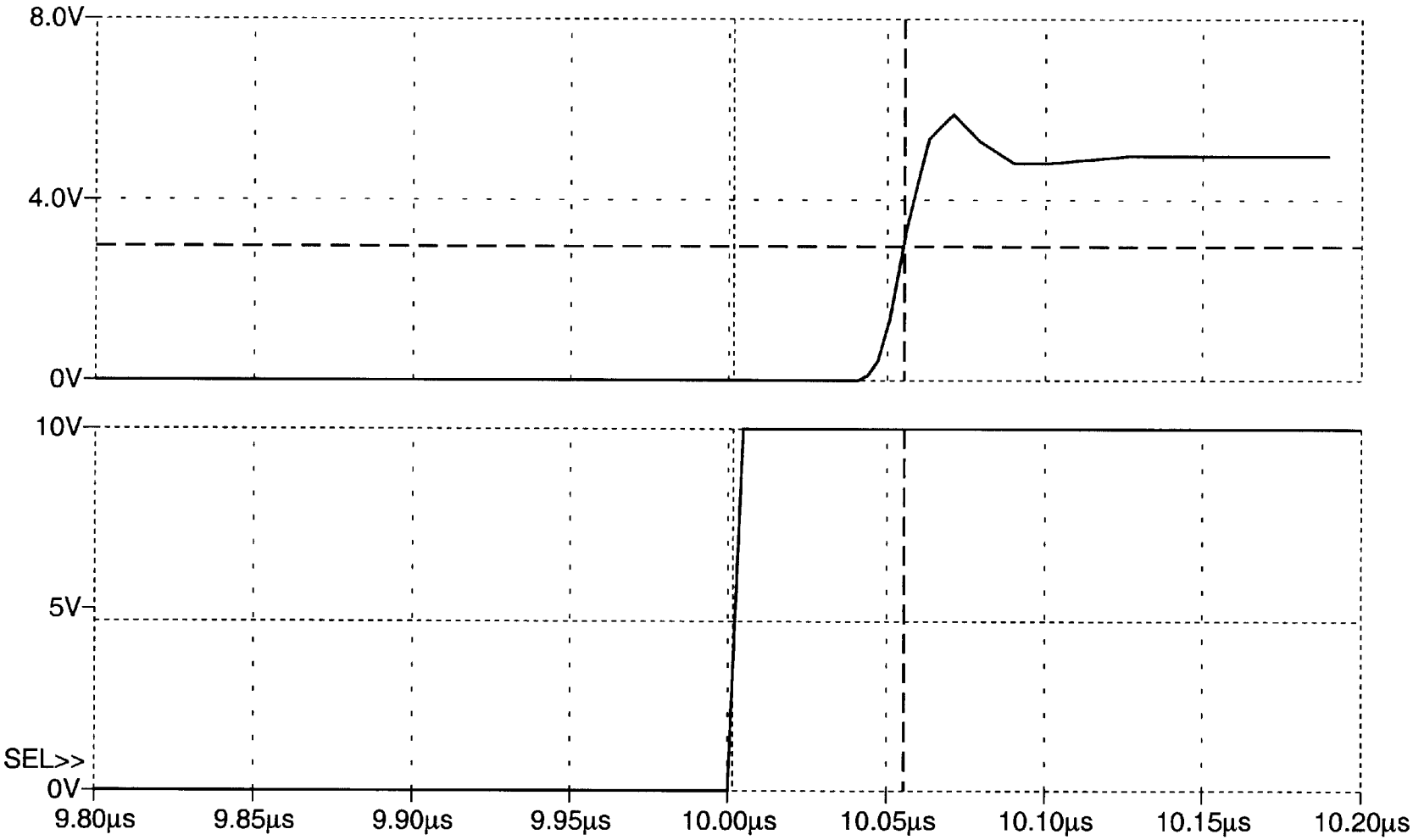
FIG. 3A is a graph of the gate-to-source transient voltage step of the last load stage in a first embodiment of the load emulator of FIG. 1 according to the present invention.
Figure 3B:
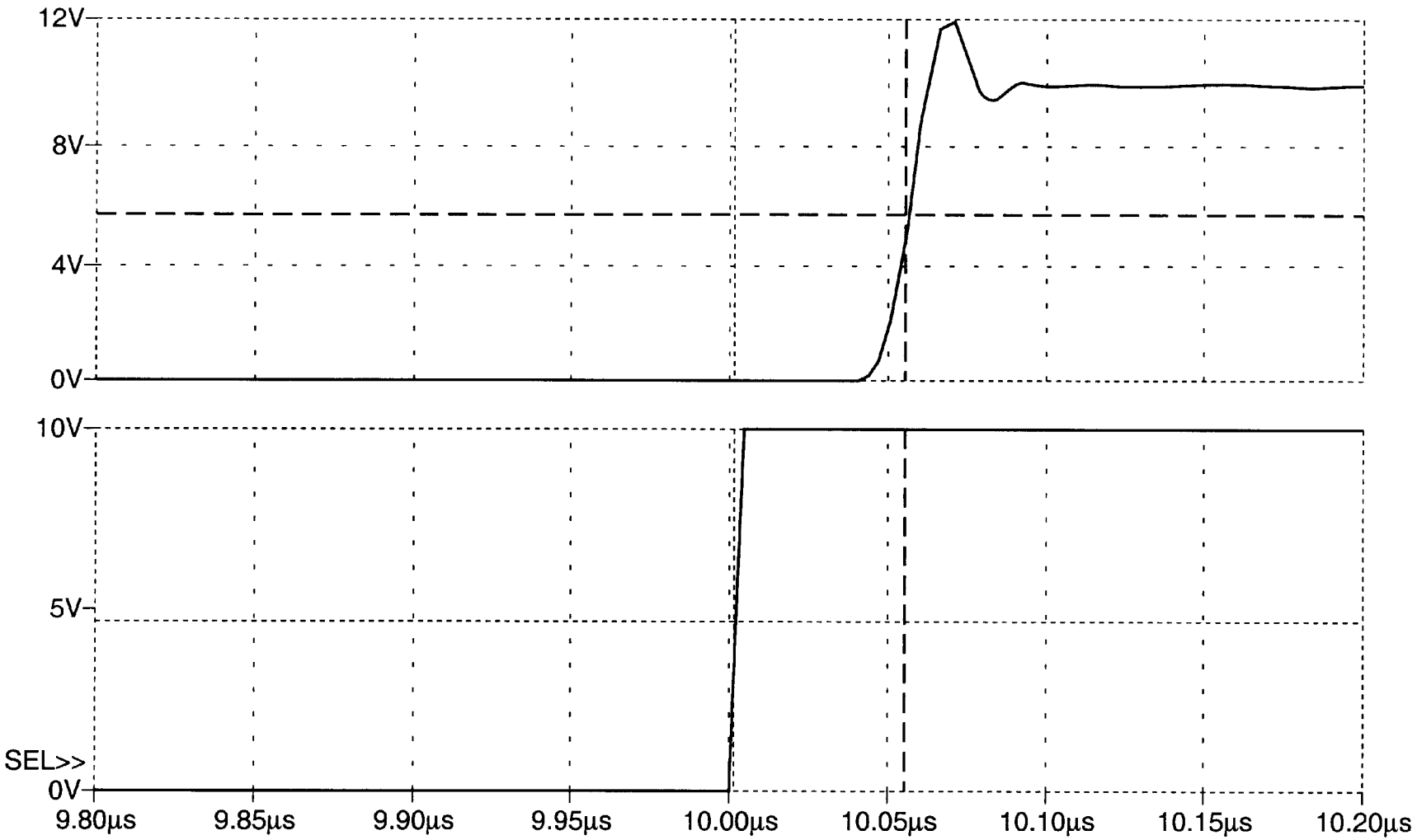
FIG. 3B is a graph of the gate-to-source transient voltage step of the last load stage in a second embodiment of the load emulator of FIG. 1 according to the present invention.

In FIGS. 3A and 3B, the gate-to-source transient voltage step of the 50th load stage 12-50 in the load emulator 10 is depicted to demonstrate that for the selected values of the characteristic impedance $Z_0$, the inductor L (24), the capacitance C due to N-channel MOS transistor 14 in a load stage 12, and the termination element 28, the 50th element will be turned on 50 ns later than the rising edge of the stimulus pulse from the pulse generator 22. Thus, the lower plots in FIGS. 3A and 3B are of the input signal to the load emulator 10 and the upper plots are of the delayed output signal. Consequently, if each load stage 12 in the load emulator 10 is delayed by an equal amount of 1 ns, and each load stage 12 contributes a predetermined portion of the load in the load emulator 10, such as 1 A, after 50 ns, a total load current of 50 A will be provided. In this example, $R_s=Z_0=2.21$ ohms, L=2.2 nH, C=450 pF and termination element 28=$R_1-R_s=Z_0=2.21$ ohms resistance.

FIG. 3B is different from FIG. 3A, in that the FIG. 3B reflects the impact of no termination resistance.

Figure 4A:
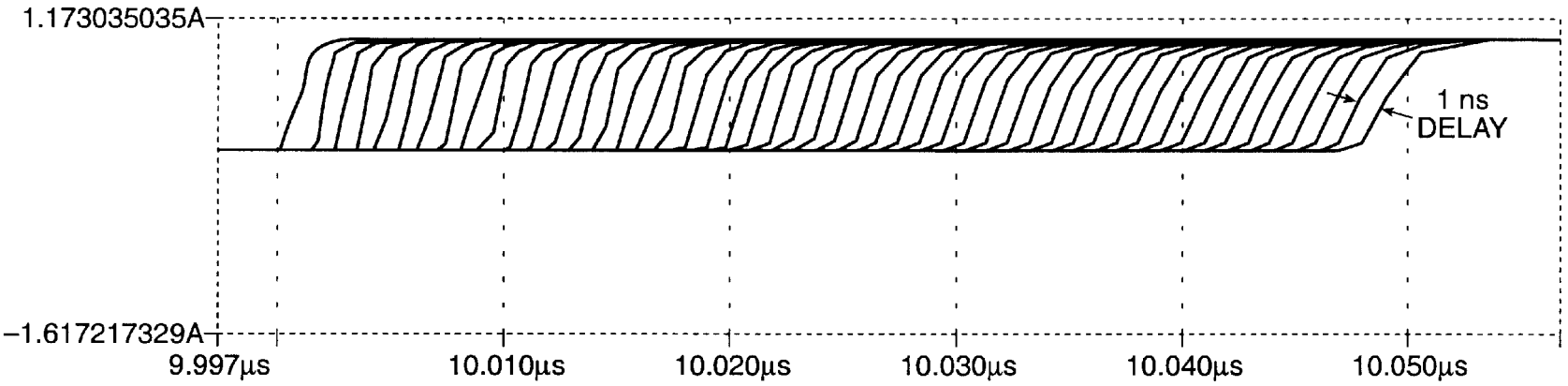
FIG. 4A is a graph illustrating the separate dI/dt response of each of the load stages of a load emulator in accordance with an embodiment of the present invention.
Figure 4B:
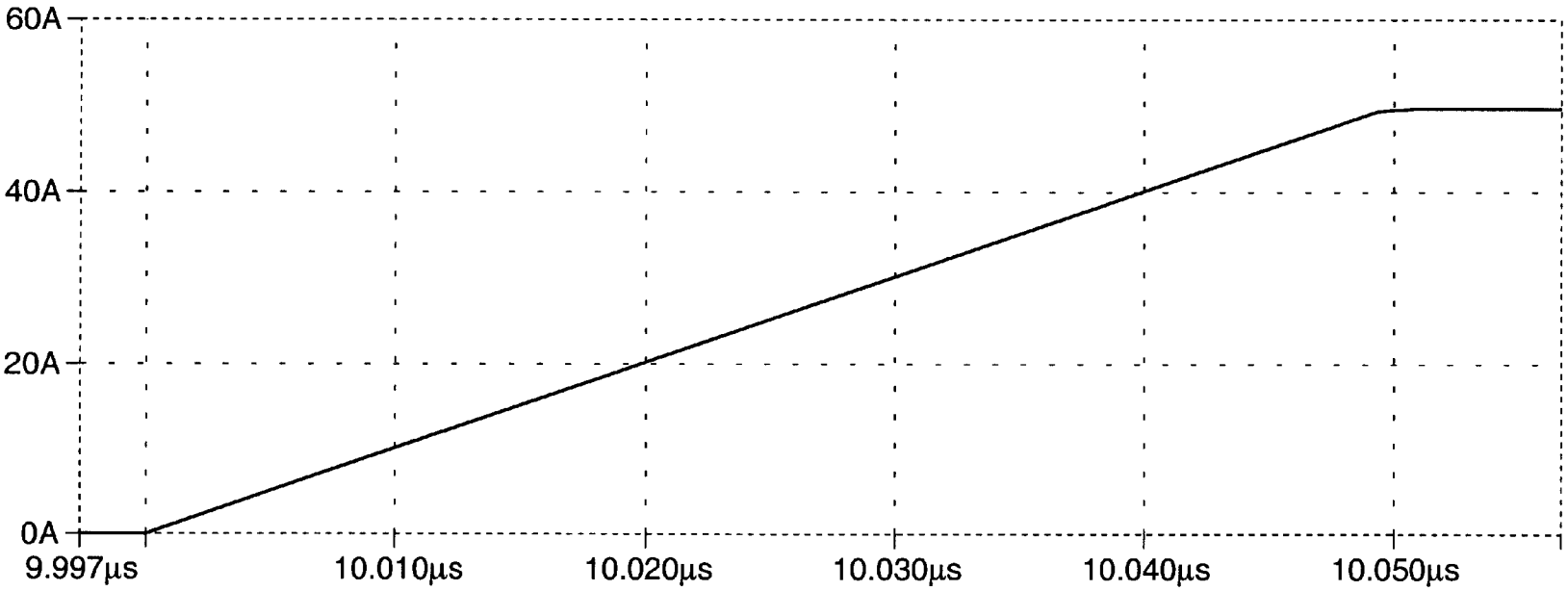
FIG. 4B is a graph illustrating the cumulative dI/dt response of the load stages of a load emulator in accordance with an embodiment of the present invention.

FIG. 4A illustrates the total load current contributed by 1 A of current flowing in each of the load stages 12 and 1 ns amount of delay between each of the load stages 12. FIG. 4B illustrates the cumulative effect of the individual load current profiles generated by the load stages 12. It should be appreciated that the cumulative load current profile is relatively smooth, despite the relatively coarse 1 A increment at the load stages 12.

Finally, it should be appreciated that because the load emulator according to the present invention is a very simple implementation and requires very little board space, that a simple drive source is adequate and the number of parallel paths formed by the load stages 12 can be readily increased beyond the 50 given as an example herein. Because the generated heat is evenly distributed among the N-channel MOS transistors in the load stages, no heat sink is required. A further advantage is that the N-channel MOS transistors employed according to the present invention do not require a fast switching response because the rise time of any individual N-channel MOS transistor is canceled with respect to other N-channel MOS transistors in other load stages. Any slow switching due to an N-channel MOS transistor of a load stage only results in an initial delay of the pulse from the pulse generator.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A load emulator comprising:

a plurality of load stages, each of said plurality of load stages having an input, an output, and a capacitive element coupled to said input, each output of said plurality of load stages coupled in a parallel connection to form an output of said load emulator;

a plurality of inductive elements, each of said inductive elements having a first end and a second end, each of said inductive elements coupled in a series connection wherein said first end of each of said inductive elements, except said first end of a first inductive element in said series connection, is coupled to a second end of a separate one of said plurality of inductive elements, said first end of said first inductive element in said series connection coupled to an impedance element, each input of said plurality of load stages, except said input of a first load stage in said parallel connection, coupled to a second end of a separate one of said plurality of inductive elements, said input of said first load stage in said parallel connection coupled to said impedance element; and a termination coupled to a second end of a last impedance element in said series connection.

2. A load emulator comprising:

a plurality of load stages, each of said plurality of load stages having an input, an output, and a capacitive element coupled to said input, each output of said plurality of load stages coupled in a parallel connection to form an output of said load emulator;

a plurality of impedance elements coupled in a series connection, each of said impedance elements having a first end and a second end, each input of said plurality of load stages coupled to a second end of a separate one of said plurality of impedance elements, and a termination coupled to a second end of a last impedance element in said series connection.

3. A load emulator comprising:

a plurality of load stages, each of said plurality of load stages having a control input, a first output, a second output, and a capacitive element coupled to said control input, each first output of said plurality of load stages coupled to a first node, each second output of said plurality of load stages coupled to a second node, said first and second nodes forming an output of said load emulator; and a plurality of inductive elements, each of said inductive elements having a first end and a second end, each of said inductive elements coupled in a series connection wherein said first end of each of said inductive elements, except said first end of a first inductive element in said series connection, is coupled to a second end of a separate one of said plurality of inductive elements, said first end of said first inductive element in said series connection coupled to an impedance element, each control input of said plurality of load stages, except said control input of a first load stage in said parallel connection, coupled to a second end of a separate one of said plurality of inductive elements, said control input of said first load stage in said parallel connection coupled to said impedance element; and a termination coupled to a second end of a last impedance element in said series connection.

4. A load emulator comprising:

a plurality of load stages, each of said plurality of load stages having a control input, a first output, a second output, and a capacitive element coupled to said control input, each first output of said plurality of load stages coupled to a first node, each second output of said plurality of load stages coupled to a second node, said first and second nodes forming an output of said load emulator;

a plurality of impedance elements coupled in a series connection, each of said impedance elements having a first end and a second end, each control input of said plurality of load stages coupled to a second end of a separate one of said plurality of impedance elements, and a termination coupled to a second end of a last impedance element in said series connection.

5. A load emulator comprising:

a plurality of load stages, each of said plurality of load stages having an input, an output, each output of said plurality of load stages coupled in a parallel connection to form an output of said load emulator; and a delay line having a plurality of impedance elements and a plurality of capacitive elements, said plurality of impedance elements coupled in a series connection, each of said impedance elements having a first end and a second end, said capacitive elements having a first end and a second end, said first end of a separate one of said plurality of capacitive elements coupled to a second end of a separate one of said impedance elements, said second end of a separate one of said plurality of capacitive elements coupled to a separate input of said plurality of load stages; and a termination coupled to said second end of a last impedance element in said series connection.

6. A load emulator comprising:

a plurality of load stages, each of said plurality of load stages having a control input, a first output, and a second output, each first output of said plurality of load stages coupled to a first node, each second output of said plurality of load stages coupled to a second node, said first and second nodes forming an output of said load emulator;

a delay line having a plurality of impedance elements and a plurality of capacitive elements, said plurality of impedance elements coupled in a series connection, each of said impedance elements having a first end and a second end, said capacitive elements having a first end and a second end, said first end of a separate one of said plurality of capacitive elements coupled to a second end of a separate one of said impedance elements, said second end of a separate one of said plurality of capacitive elements coupled to a separate control input of said plurality of load stages; and a termination coupled to said second end of a last impedance element in said series connection.

7. A load emulator comprising:

a plurality of load stages, each of said plurality of load stages having an input, an output, each output of said plurality of load stages coupled in a parallel connection to form an output of said load emulator;

a delay line having a plurality of taps, a first end and a second end, separate ones of said plurality of taps coupled to a separate input of said plurality of load stages; and a termination coupled to said second end of said delay line.

8. A load emulator comprising:

a plurality of load stages, each of said plurality of load stages having a control input, a first output, and a second output, each first output of said plurality of load stages coupled to a first node, each second output of said plurality of load stages coupled to a second node, said first and second nodes forming an output of said load emulator;

a delay line having a plurality of taps, a first end and a second end, separate ones of said plurality of taps coupled to a separate control input of said plurality of load stages; and a termination coupled to said second end of said delay line.

9. A load emulator comprising:

a plurality of load stages, each of said plurality of load stages having an MOS transistor having a first source/drain, a second source/drain, and a gate, and a resistor having a first end and a second end, each first end of said resistor coupled to said first source/drain of said MOS transistor in each of said plurality of load stages, each second end of each resistor coupled together to form a first node, each second source/drain of each MOS transistor coupled together to form a second node, said first and second nodes forming an output of said load emulator;

a plurality of inductive elements, each of said inductive elements having a first end and a second end, each of said inductive elements coupled in a series connection wherein said first end of each of said inductive elements, except said first end of a first inductive element in said series connection, is coupled to a second end of a separate one of said plurality of inductive elements, said first end of said first inductive element in said series connection coupled to an impedance element, each gate of said MOS transistor of said plurality of load stages, except said gate of said MOS transistor of a first load stage in said parallel connection, coupled to a second end of a separate one of said plurality of inductive elements, said gate of said MOS transistor of said first load stage in said parallel connection coupled to said impedance element; and a termination coupled to a second end of a last impedance element in said series connection.

10. A load emulator comprising:

a plurality of load stages, each of said plurality of load stages having an MOS transistor having a first source/drain, a second source/drain, and a gate, and a resistor having a first end and a second end, each first end of said resistor coupled to said first source/drain of said MOS transistor in each of said plurality of load stages, each second end of each resistor coupled together to form a first node, each second source/drain of each MOS transistor coupled together to form a second node, said first and second nodes forming an output of said load emulator;

a plurality of impedance elements coupled in a series connection, each of said impedance elements having a first end and a second end, each gate of said MOS transistor of said plurality of load stages coupled to a second end of a separate one of said plurality of impedance elements, and a termination coupled to a second end of a last impedance element in said series connection.

* * * * *

UNITED STATES PATENT AND TRADEMARK OFFICE

CERTIFICATE OF CORRECTION

PATENT NO: 6,046,581
DATED: April 4, 2000
INVENTOR(S): Lajos Burgyan

It is certified that error appears in the above-identified patent and that said Letter Patent are hereby corrected as shown below:

In Col. 2, line 13, replace "dl/dt" with --dI/dt--.

Signed and Sealed this

Tenth Day of April, 2001

*Attest:*

Nicholas P. Godici

NICHOLAS P. GODICI

*Attesting Officer*

*Acting Director of the United States Patent and Trademark Office*